US005901373A

United States Patent [19]

Dicker

[11] Patent Number: 5,901,373

[45] Date of Patent: May 11, 1999

[54] MULTILAYER ENERGY EXPENDITURE GARMENT MADE FROM HYDROPHOBIC/ HYDROPHILIC MATERIALS

[76] Inventor: Timothy P. Dicker, 6906 Foothill Blvd., Tujunga, Calif. 91042-2780

[21] Appl. No.: 08/975,450

[22] Filed: Nov. 21, 1997

[51] Int. Cl.[6] ..... A41D 13/00

[52] U.S. Cl. ..... 2/69; 2/243.1

[58] Field of Search ..... 2/69, 49.4, 227, 2/228, 238, 79, 78.1, 239, 400, 402, 403, 406, 407, 243.1; 428/91, 97, 913

[56] References Cited

U.S. PATENT DOCUMENTS 4,560,611 12/1985 Naka et al. .
5,126,182 6/1992 Lumb et al. .
5,217,782 6/1993 Moretz et al. .
5,306,536 4/1994 Moretz et al. .
5,390,376 2/1995 Marx et al. .
5,636,380 6/1997 Schindler et al. .

*Primary Examiner*—Gloria Hale
*Attorney, Agent, or Firm*—Connolly & Hutz

[57] ABSTRACT

An energy expenditure garment includes at least a portion of the garment made from multilayer construction which has an inner layer of hydrophobic material to direct moisture away from the skin with an intermediate layer of hydrophilic material to store the moisture. An outer layer of non-porous and non-moisture permeable material is provided outwardly of the storage layer to act as a barrier or wall for preventing evaporation of the moisture stored in the intermediate layer. Preferably, a moisture vapor transmission membrane is provided between the hydrophobic inner layer and the hydrophilic storage layer to provide one way flow of the moisture to the storage layer.

23 Claims, 3 Drawing Sheets

MULTILAYER ENERGY EXPENDITURE GARMENT MADE FROM HYDROPHOBIC/ HYDROPHILIC MATERIALS

BACKGROUND OF THE INVENTION

The present invention relates to sports clothing worn during the performance of some activity which would result in perspiration. Various garments have been suggested for directing moisture or perspiration away from the user's body in an attempt to keep the user drier, cooler and more comfortable. Examples of patents disclosing garments pertinent to the present invention are U.S. Pat. Nos. 4,560,611, 5,126,182, 5,306,536, 5,217,782, 5,390,376 and 5,636,380.

SUMMARY OF THE INVENTION

An object of this invention is to provide an energy expenditure garment which provides moisture control.

A further object of this invention is to provide such a garment which utilizes multi-layer structure to direct perspiration away from the body.

In accordance with this invention an energy expenditure garment is provided which includes a torso section and a pants section with downwardly extending legs. At least a portion of the garment is of multi-layer construction which includes an inner layer of hydrophobic material to direct moisture away from the skin of the wearer. The multi-layer construction also includes an intermediate layer of hydrophilic material for storing the moisture and includes an outer layer made of non-porous and non-moisture permeable material to create a barrier wall for preventing evaporation of the moisture stored in the intermediate layer.

The invention may also be practiced by providing a further intermediate layer between the hydrophobic layer and the hydrophilic storage layer wherein the further intermediate layer is a moisture vapor transmission membrane to facilitate movement of the fluid in a one way direction away from the skin.

The invention may also be practiced with a layer outwardly of the outer layer which is made of a hydrophilic material to capture water from the atmosphere thereby increasing the weight load.

THE DRAWINGS

DETAILED DESCRIPTION

The present invention relates to a multi-layer moisture control garment which directs the perspiration away from the body and stores the perspiration or moisture in one of the layers, namely a hydrophilic layer which is disposed inwardly of a barrier wall area. Such multi-layer construction could be incorporated as the material of the entire garment or could be incorporated in only selected portions of the garment. Various practices of the invention include having the perspiration directed away from the body and transported into a highly hydrophilic layer via a hydrophobic first or inner layer and an intermediate hydrophobic driver membrane. Perspiration is allowed to be transported and stored locally over the muscle group or transported distally via the TEFLON (polytetrafluorethylene) coated hydrophobic layer and allowed to accumulate around the knee joint or ankle joint. TEFLON is a trademark of E. I. DuPont de Nemours & Company for polytetrafluoroethylene. In the thorax the accumulated areas would be in the elbow, wrist, posterior scapular and pectoral regions. It is known that 1.5 to 2.0 liters [50–68 ounces] of fluid is lost from the body in one hour during a moderate exercise. Redirecting the weight and load of this fluid back on to the long axis would increase the amount of work load enhancing the exercise. Not accounting for additional rehydration, fabric drag and muscle fatigue there should be a substantial added load factor to the working system by the added weight of the fluid. Heat build-up should not be a problem because the heat is being pulled away via the fluid from the large muscle groups. A sensor either a Ph sensor or a fluid level or some other type of sensor could be placed in the storage layer to signal the user to rehydrate.

Figure 1:
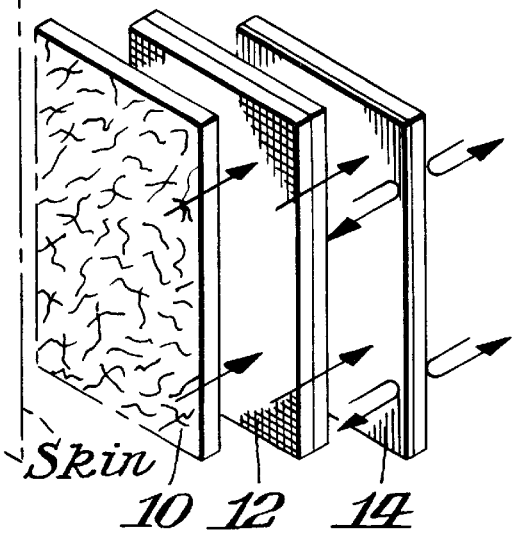
FIG. 1 is an exploded view of a multi-layer construction used in energy expenditure garment in accordance with this invention.
Figure 2:
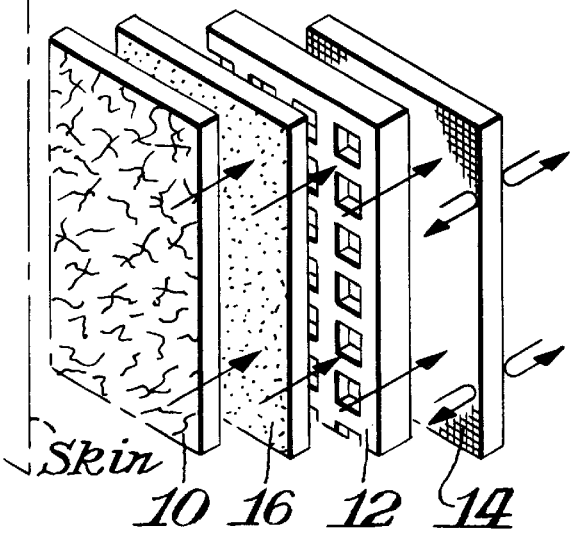
FIGS. 2 and 3 are views similar to FIG. 1 of variations of the multi-layer construction.
Figure 3:
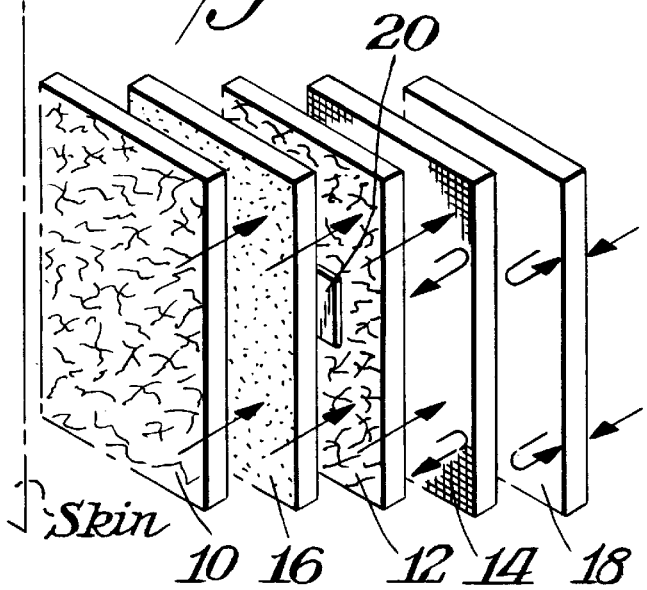
Figure 4:
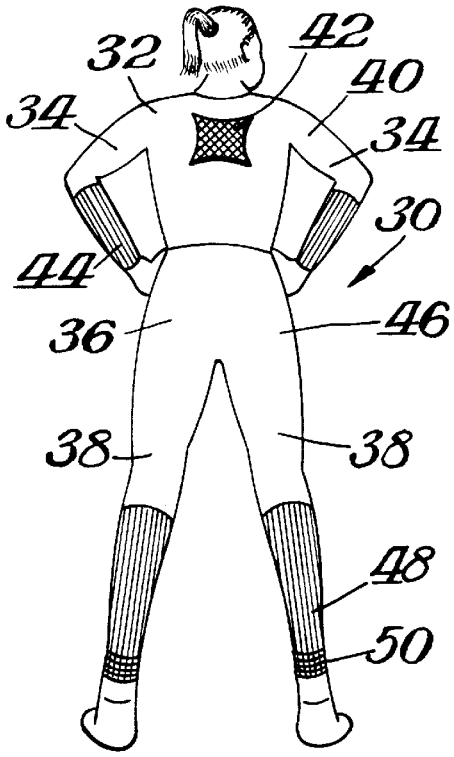
FIG. 4 is a posterior view showing one form of garment on a wearer wherein the garment includes a multi-layer construction in accordance with this invention.
Figure 1A:
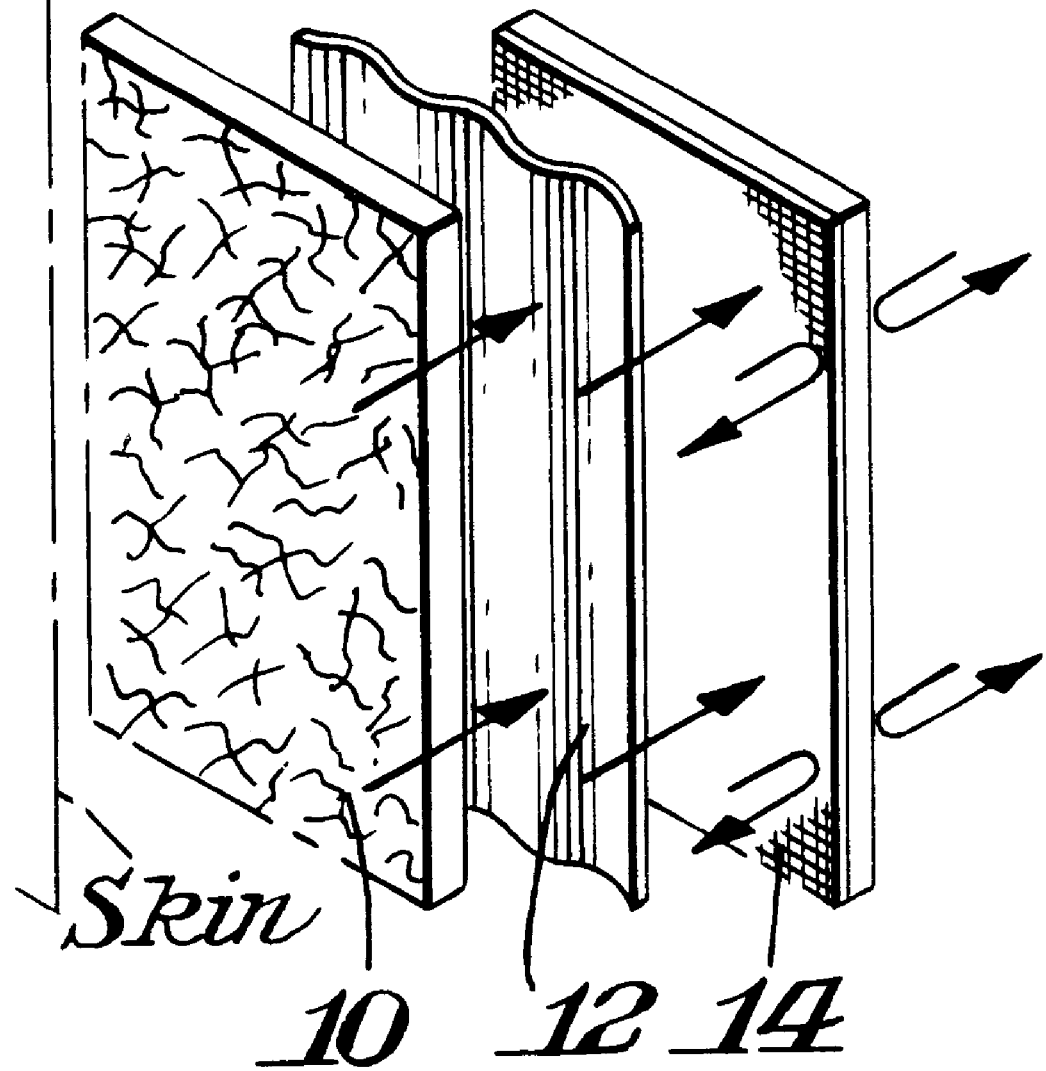
FIG. 1A is a view similar to FIG. 1 showing a variation which includes a convoluted layer.

FIGS. 1–3 illustrate variations in the multi-layer structure which could be incorporated in the energy expenditure garment of this invention. FIG. 1 illustrates the basic design. As shown therein a first or inner layer 10 would be located against the skin. Layer 10 is made of a hydrophobic material to pull moisture away from the skin. The material may be a thick/brushed material to increase the surface area. Such a material could be COOLMAX, a trademark of E. I. DuPont de Nemours & Company for fabric. Adjacent to the inner layer 10 is a second or intermediate layer 12 made of a hydrophilic material to store the moisture or liquid directed to layer 12 by inner layer 10. Layer 12 may be a single layer as shown in FIGS. 2–3 or as illustrated as FIG. 1 could itself be multi-layered. Layer 12 could be of convoluted configuration as shown in FIG. 4 or could have pockets or include other structure to increase its surface area such as shown in FIG. 2. A suitable material would be cotton or any of the highly hydrophilic fabrics made by the DuPont Company.

As also shown in FIG. 1 the basic design includes a third or outer layer 14 disposed toward the outside of the garment. Layer 14 is made of non-porous/non-moisture permeable material which does not permit evaporation. A suitable material would be woven nylon with a treated surface. Such materials could be TACTEL, a trademark of E. I. DuPont de Nemours & Company for yarns. Thus, the basic design of FIG. 1 is a hydrophobic layer disposed against the skin to transmit or direct moisture to the intermediate hydrophilic storage layer with the outer layer being a barrier or wall which prevents evaporation.

FIG. 2 shows a variation of the basic design wherein a further intermediate layer 16 made of a membrane that allows movement of fluid in one direction is provided between inner layer 10 and intermediate storage layer 12. Layer 16 thus allows movement of fluid in a one way direction away from the skin to assure that the moisture will be collected in and stored by hydrophilic layer 12. A suitable material for layer 16 is a moisture vapor transmission membrane by the DuPont Company. In the embodiment of FIG. 2 where a moisture vapor transmission membrane is disposed against storage layer 12, the storage layer could be of the materials referred to with respect to layer 12 of FIG. 1 or could be THERMASTAT. The multi-layer construction of FIG. 2 thus results in an inner hydrophobic layer disposed against the skin for transmitting fluid to a moisture vapor transmission membrane which then transmits the fluid or perspiration to the hydrophilic storage area with the outer wall or barrier layer preventing evaporation.

FIG. 3 shows yet a further variation of the invention wherein a fifth or outside layer 18 is disposed outwardly of the outer layer 14. Layer 18 is made of a hydrophilic material to capture water from the atmosphere thereby increasing the weight load. The arrangement resulting from the construction of FIG. 3 is a hydrophobic layer adjacent to the moisture vapor transmission membrane which is adjacent to the hydrophilic layer which is disposed against the barrier or wall layer with a hydrophilic layer being outwardly of the barrier or wall layer. The hydrophilic outside layer 18 may also be provided in the arrangement of the construction of FIG. 1 which omits the moisture vapor transmission membrane.

The various constructions shown in FIGS. 1–3 could be made as a laminate or could be singly applied when forming the garment.

If desired, a sensor 20 such as a Ph sensor or a fluid level sensor or any other suitable type of sensor could be placed in the storage layer 12 to signal the user to rehydrate. FIG. 3 illustrates the incorporation of the sensor 20. It is to be understood that such sensor could also be located in the construction of FIGS. 1 and 2.

FIG. 4 shows the posterior view of a garment 30 in accordance with this invention. As shown therein the garment 30 includes a torso section 32 which has outwardly extending arms 34 and a pants section 36 having downwardly extending legs 38. Garment 30 is made of a base fabric 40 in the torso section 32. The fabric 40 would be made of a composite consisting of inner layer 10, moisture vapor transmission layer 16 and hydrophilic layer 12. Torso section 32 also includes a storage pad 42 made of a composite of inner layer 10, moisture vapor transmission layer 16, storage layer 12 and wall layer 14. The arms 34 include material 44 which provide dependent/gravity storage. Material 44 is made of a laminate or composite comprising inner layer 10, moisture vapor transmission membrane 16, storage layer 12 and wall layer 14. Pants section 36 is made of base fabric 46 consisting of a laminate of inner layer 10 and moisture vapor transmission layer 16 allowing only the moisture to transport down the outer face of the layer 16 to the dependent storage of the hydrophilic wall parts of the lower leg. Thus the base fabric 46 leads to the lower leg fabric 48 which additionally includes the storage layer 12 and wall layer 14. Material 50 is located at the ankles and has the most dependent and highest concentration of hydrophilic material. Material 50 would thus include the multilayer construction of FIGS. 1, 2 or 3.

Figure 5:
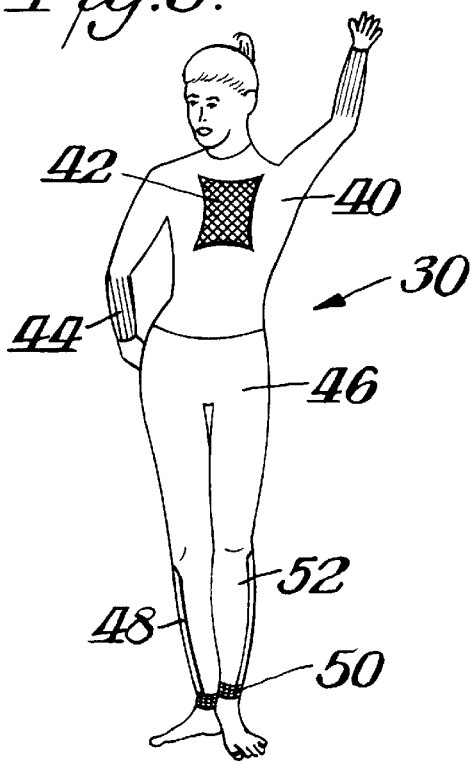
FIG. 5 is an anterior view of the garment shown in FIG. 4.

FIG. 5 illustrates the anterior view of the garment 30 of FIG. 4. As shown therein the torso section would be made of fabric 40 and would include a storage pad 42 with the arms including the dependent gravity storage material 44. The pants section would be made of material 46. In the anterior portion of the garment, however, the layer 48 does not or only partially comes around the front because the front is a bony surface with only limited moisture loss. Thus, the material 52 in the anterior portion of the legs is simply covered with a hydrophilic layer such as COOLMAX and extends to the ankle area which has the material 50 forming a band or ring. The layer 50 includes the high concentration of hydrophilic material 12 covered by wall layer 14. By completing a ring of hydrophilic material around the ankles there is assurance of storing moisture and creating a load to the system.

Figure 7:
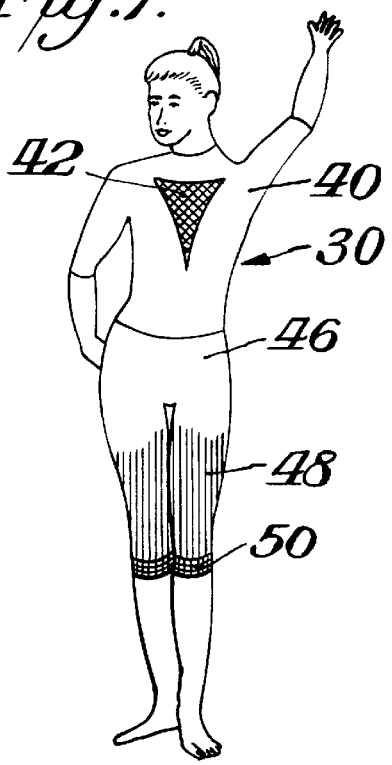
FIGS. 6–7 are posterior and anterior views of a modified garment in accordance with this invention.
Figure 6:
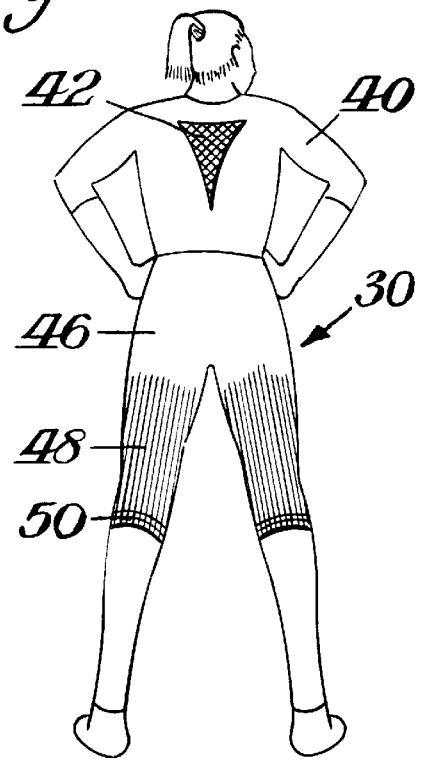

FIGS. 6–7 illustrate a variation of the garment 30 which includes a short top and short legs which extend only slightly below the knee. The garment in FIGS. 6–7 would include the same materials as in the garment of FIGS. 4–5 as indicated by the appropriate reference numerals.

Figure 8:
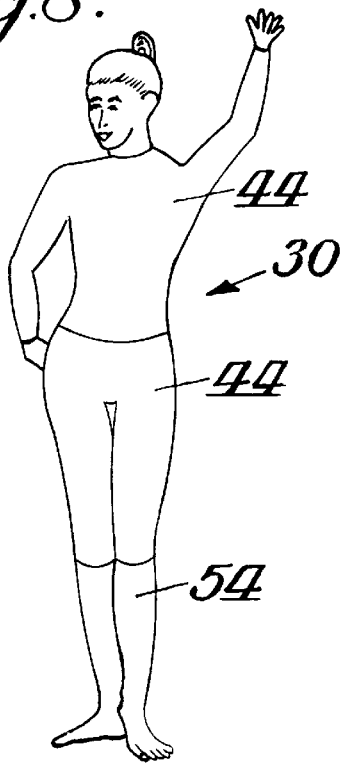
FIG. 8 is an anterior view of a further garment in accordance with this invention.

FIG. 8 is an anterior view of a garment 30 which may have a long or short top and pants that extend to slightly above the knee. As shown therein the entire garment is made of a composite such as material 44 which includes the multilayer construction of FIGS. 1–3 and preferably of FIG. 2. Such material allows the entire suit to store moisture away from the skin and create an even load. Because the legs 54 are of a bony surface there is little or no moisture loss. Thus the legs 54 can be completely exposed or can be covered solely with a material such as layer 10.

Where a sensor such as sensor 20 is incorporated in the storage layer 12 it is preferable to locate the sensor in an area having the most concentration of hydrophilic material such as in an ankle band 50.

As can be appreciated the present invention thus provides a multi-layered moisture transport and retaining fabric/apparel. The skin layer 10 can be made from a thick/brushed hydrophobic fiber which can be lined on the transport surface with a non-stick material such as TEFLON to aid in the transporting of the moisture to the storage layer 12. A intermediate layer in the form of a moisture vapor transmission membrane can be provided to allow moisture to pass through the membrane, but prevent the moisture from returning thereby keeping the skin dry. The storage layer 12 is preferably made by high hydrophobic mini-layered convoluted material to increase the surface storage area. The outermost layer 14 is a non-absorbent non-permeable fabric which allows the hydrophilic layer to accumulate and store moisture.

It is to be understood that various features shown for specific embodiments may be used with other embodiments.

What is claimed is:

1. An energy expenditure garment for controlling moisture resulting from perspiration during use of said garment, said garment having a torso section and a pants section with downwardly extending legs, at least a portion of said garment being of multilayer construction, said multilayer construction including an inner layer of hydrophobic material to direct moisture away from the skin of a wearer, an intermediate storage layer of hydrophilic material for storing the moisture directed thereto by said inner layer, and an outer layer of non-porous and non-moisture permeable material to act as a barrier wall for preventing evaporation of the moisture stored in said intermediate storage layer.

2. The garment of claim 1 including a moisture vapor transmission membrane layer is between said inner layer and said storage layer.

3. The garment of claim 2 including an outside layer disposed outwardly of said outer layer, said outside layer being made of a hydrophilic material to capture moisture from the atmosphere and thereby increase the weight load.

4. The garment of claim 3 including a moisture sensor incorporated in said storage layer.

5. The garment of claim 1 wherein said storage layer is convoluted.

6. The garment of claim 1 including a moisture sensor incorporated in said storage layer.

7. The garment of claim 1 wherein said inner layer is made from thick/brushed hydrophobic fiber.

8. The garment of claim 7 wherein said fiber is lined with non-stick material.

9. The garment of claim 1 including at least one storage pad made from said multi-layer construction.

10. The garment of claim 9 wherein said torso section includes outwardly extending arms, and said storage pad being located at the elbow portion of said arms.

11. The garment of claim 9 wherein said torso section includes outwardly extending arms, and said storage pad being located at the wrist portions of said arms.

12. The garment of claim 9 wherein said storage pad is located in the posterior scapular region.

13. The garment of claim 9 wherein said storage pad is located in the anterior pectoral region.

14. The garment of claim 9 including a sensor mounted to said storage layer in the ankle portions of said legs.

15. The garment of claim 1 including a storage pad located in the anterior and posterior regions of said torso section.

16. The garment of claim 15 wherein said multi-layered construction includes a moisture vapor transmission membrane located between said inner layer and said storage layer.

17. The garment of claim 16 wherein said torso section and said pants section are made of basic material comprising an inner layer of hydrophobic material for being disposed against the skin, a moisture vapor transmission membrane disposed against said inner layer, and a storage layer made of hydrophilic material disposed against said membrane.

18. The garment of claim 17 wherein said torso section includes outwardly extending arms, dependent/gravity storage regions located at said arms and said legs, said dependent/gravity storage regions being made of said multilayer construction, and said multilayer construction including a moisture vapor transmission membrane located between said inner layer and said storage layer.

19. The garment of claim 18 including an endless cuff located at the end of each of said legs, said endless cuff being made of said multilayer construction, and said endless cuff having a higher concentration of hydrophilic material than said dependent/storage regions.

20. The garment of claim 19 wherein said legs extend to the ankle portions, and said endless cuffs being at said ankle portions.

21. The garment of claim 19 wherein said legs terminate at about the knee portions, and said endless cuffs being at said knee portions.

22. The garment of claim 1 wherein said entire garment is made of said multilayer construction.

23. The garment of claim 22 wherein said multilayer construction includes a moisture transport transmission membrane located between said inner layer and said storage layer.

* * * * *